US009144132B2

(12) United States Patent
Hoover

(10) Patent No.: US 9,144,132 B2
(45) Date of Patent: Sep. 22, 2015

(54) BRIGHTNESS CONTROL OF A STATUS INDICATOR LIGHT

(71) Applicant: Apple Inc., Cupertino, CA (US)

(72) Inventor: Bryan Hoover, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/109,720

(22) Filed: Dec. 17, 2013

(65) Prior Publication Data

US 2014/0103831 A1 Apr. 17, 2014

Related U.S. Application Data

(60) Continuation of application No. 12/819,376, filed on Jun. 21, 2010, now Pat. No. 8,610,367, which is a division of application No. 11/558,376, filed on Nov. 9, 2006, now Pat. No. 8,373,355.

(51) Int. Cl.
*H05B 37/02* (2006.01)
*H05B 33/08* (2006.01)

(52) U.S. Cl.
CPC ..... *H05B 33/0845* (2013.01)

(58) Field of Classification Search
USPC ..... 315/291, 247, 393, 169–169.03, 250; 345/393, 76, 55, 102, 694, 74.1, 690, 345/87, 73, 83; 455/566
See application file for complete search history.

(56) References Cited

U.S. PATENT DOCUMENTS

| | | | |
|---|---|---|---|
| 4,714,823 | A | 12/1987 | Spruck et al. |
| 4,769,753 | A | 9/1988 | Knudson et al. |
| 5,223,814 | A | 6/1993 | Suman |
| 5,497,181 | A | 3/1996 | Paoli |
| 6,095,661 | A | 8/2000 | Lebens et al. |
| 6,147,664 | A | 11/2000 | Hansen |
| 6,271,825 | B1 | 8/2001 | Greene et al. |
| 6,305,818 | B1 | 10/2001 | Lebens et al. |
| 6,674,561 | B2 | 1/2004 | Ohnishi et al. |
| 6,720,743 | B2 | 4/2004 | Yano et al. |
| 6,794,996 | B2 | 9/2004 | Tsutsui et al. |
| 6,841,947 | B2 | 1/2005 | Berg-johansen |
| 6,857,748 | B2 | 2/2005 | Roddy et al. |
| 6,897,884 | B2 | 5/2005 | Tsuge et al. |
| 7,008,090 | B2 | 3/2006 | Blank |
| 7,030,956 | B2 | 4/2006 | Nishi et al. |
| 7,109,465 | B2 | 9/2006 | Kok et al. |
| 7,186,000 | B2 | 3/2007 | Lebens et al. |
| 7,236,154 | B1 | 6/2007 | Kerr et al. |
| 7,256,552 | B2 | 8/2007 | Ishii et al. |

(Continued)

FOREIGN PATENT DOCUMENTS

| | | |
|---|---|---|
| CN | 201185147 | 1/2009 |
| JP | 04212289 | 8/1992 |

(Continued)

*Primary Examiner* — Hung T Vy

(74) *Attorney, Agent, or Firm* — Joseph F. Guihan

(57) ABSTRACT

An apparatus and method for controlling the brightness and luminance of a light, such as an LED. The embodiment may vary the brightness and luminance of the LED in a variety of ways to achieve a variety of effects. The exemplary embodiment may vary the rate at which the LED's luminance changes, such that an observer perceives the change in the LED's brightness to be smooth and linear as a function of time, regardless of the ambient light level. Changes to the LED's luminance may be time-constrained and/or constrained by a maximum or minimum rate of change.

11 Claims, 8 Drawing Sheets

(56) References Cited

U.S. PATENT DOCUMENTS

| | | | | |
|---|---|---|---|---|
| 7,425,801 | B2 * | 9/2008 | Ozaki | 315/291 |
| 7,446,303 | B2 | 11/2008 | Maniam et al. | |
| 7,468,722 | B2 | 12/2008 | Ferguson | |
| 7,477,228 | B2 | 1/2009 | Wyatt | |
| 7,501,960 | B2 | 3/2009 | Price et al. | |
| 7,573,472 | B2 | 8/2009 | Aoki et al. | |
| 7,675,249 | B2 | 3/2010 | Furukawa et al. | |
| 7,750,282 | B2 | 7/2010 | Mahowald et al. | |
| 7,769,353 | B2 | 8/2010 | Dietrich et al. | |
| 7,835,164 | B2 | 11/2010 | Lyle | |
| 7,903,062 | B2 | 3/2011 | Miyachi et al. | |
| 7,999,852 | B2 | 8/2011 | Deroo et al. | |
| 8,373,355 | B2 | 2/2013 | Hoover et al. | |
| 8,610,367 | B2 | 12/2013 | Hoover | |
| 2004/0017158 | A1 | 1/2004 | Ang et al. | |
| 2005/0017778 | A1 * | 1/2005 | Nogawa et al. | 327/165 |
| 2005/0168168 | A1 * | 8/2005 | Elliott | 315/247 |
| 2005/0202851 | A1 * | 9/2005 | Yamamoto et al. | 455/566 |
| 2006/0001641 | A1 | 1/2006 | Degwekar et al. | |
| 2006/0082538 | A1 * | 4/2006 | Oyama | 345/102 |
| 2006/0103612 | A1 * | 5/2006 | Ozaki | 345/83 |
| 2006/0145960 | A1 * | 7/2006 | Koga et al. | 345/76 |
| 2006/0152468 | A1 * | 7/2006 | Ozaki | 345/102 |
| 2006/0232216 | A1 | 10/2006 | Kosaka | |
| 2007/0018919 | A1 | 1/2007 | Zavracky et al. | |
| 2007/0194718 | A1 | 8/2007 | Foo | |
| 2008/0078921 | A1 | 4/2008 | Yang et al. | |
| 2010/0253239 | A1 | 10/2010 | Hoover | |

FOREIGN PATENT DOCUMENTS

| | | |
|---|---|---|
| JP | 04324294 | 11/1992 |
| JP | 05238309 | 9/1993 |
| JP | 06251889 | 9/1994 |
| JP | 06318050 | 11/1994 |
| JP | 07014694 | 1/1995 |
| JP | 10073865 | 3/1998 |
| JP | 2000098942 | 4/2000 |
| JP | 2005032470 | 2/2005 |
| JP | 2005293853 | 10/2005 |
| JP | 2006041043 | 2/2006 |
| KR | 100870113 | 11/2008 |
| WO | WO2007/102633 | 9/2007 |

* cited by examiner

BRIGHTNESS CONTROL OF A STATUS INDICATOR LIGHT

CROSS REFERENCE TO RELATED APPLICATION

This application is a continuation of U.S. patent application Ser. No. 12/819,376, filed Jun. 21, 2010, which is a divisional of U.S. patent application Ser. No. 11/558,376, filed Nov. 9, 2006, now U.S. Pat. No. 8,373,355, both of which are incorporated by reference in their entirety as if fully disclosed herein.

Additionally, this application is related to U.S. application Ser. No. 12/819,351, filed Jun. 21, 2010, which is also a divisional of U.S. patent application Ser. No. 11/558,376, filed Nov. 9, 2006.

BACKGROUND OF THE INVENTION

1. Field of the Invention

The present invention generally relates to the field of illumination control and more particularly involves luminance control of lights.

2. Background

Electronic devices such as computers, personal digital assistants, monitors, portable DVD players, and portable music players such as MP3 players typically have multiple power states. Two exemplary power states are "on" when the device is operating at full power and "off" when the device is turned off and uses very little or no power. Another exemplary power state is "sleep" when the device is turned on but uses less power than when in the "on" state, typically because one or more features of the device are disabled or suspended. Yet another exemplary power state is "hibernate" when the device's state is saved to non-volatile storage (typically the system's hard drive) and then the device is turned off. Sleep or hibernate states are typically used to reduce energy consumption, save battery life and enable the device to return to the "on" state more quickly than from the "off" state.

FIG. 1 is a perspective view of a computer system according to the prior art. A user may interact with the computer 100 and/or the display 105 using an input device, such as a keyboard 110 or a mouse 115. A button 120 may be used to turn on the computer 100 or the display 105. A light emitting diode ("LED") 125 may be used as a status indicator to provide information to a user regarding a current power state of the computer 100 or the display 105, and optionally other operational information, such as diagnostic codes. When the computer 100 or the display 105 is turned on, the LED 125 emits light that is seen by the user. When the computer 100 enters the sleep state, the LED 125 pulses to alert the user the computer is in the sleep state. Other prior art systems may include more complex LED behavior. For example, some prior art systems having a built-in display activate the LED only if the computer is on and the display is off. Yet other prior art systems lacking an integrated display may turn on the LED whenever the computer is turned on. It should be understood that the foregoing descriptions are a general overview only as opposed to an exact or limiting statement of the prior art.

Alternatively, the LED may be combined with button 120 made of a transparent material that covers or overlays the LED. The light emitted by the LED is transmitted through the button and is seen by the user.

The perceived brightness of the LED 125 depends on the contrast between (1) the ambient light reflecting off the area surrounding the LED and (2) the light emanating directly from the LED, due to the way the human eye functions. The human eye registers differences in contrast rather than absolutes. Thus, for example, a light that has an unchanging absolute brightness appears much brighter in a dark room than outdoors on a sunny day. Accordingly, the way the eye perceives the brightness of the LED is by its contrast relative to the ambient light reflected off the area surrounding the LED. In some environments, such as dark rooms, the light emitted by the LED can be distracting or disruptive to the user. Prior art has developed means of sensing the ambient light level and adjusting the LED's luminance in order to maintain a constant perceived brightness (i.e., constant contrast) as the ambient light changes. Prior art has also achieved partial success in controlling the rate at which the LED's luminance changes so that the user perceives an approximately linear rate of change in brightness regardless of the ambient light level. What is needed are improved methods of controlling the brightness of the LED when it is changing so that the user perceives smoother changes in the brightness of the LED to provide a more pleasing visual effect under a variety of ambient lighting conditions.

SUMMARY OF THE INVENTION

Generally, one embodiment of the present invention takes the form of an apparatus for controlling the brightness and luminance of an LED. The embodiment may vary the brightness and luminance of the LED in a variety of ways to achieve a variety of effects. For example, the exemplary embodiment may vary the rate at which the LED's luminance changes, such that an observer perceives the change in the LED's brightness to be smooth and linear as a function of time, regardless of the ambient light level.

As used herein, the term "luminance" generally refers to the actual, objective light output of a device, while the term "brightness" generally refers to the perceived, subjective light output of a device. Thus, a user will perceive a brightness in response to an LED's luminance. Further, it should be noted that the perceived instantaneous brightness of an LED is affected by many factors, such as the brightness of the surrounding area, rate of change in luminance over time, and so forth, that do not necessarily affect the LED's instantaneous luminance.

Another exemplary embodiment of the present invention may vary the luminance of an LED to avoid a sudden discontinuity in brightness. For example, the embodiment may vary the LED's luminance in such a manner as to avoid the impression of the LED abruptly changing from an illuminated state to an off state. This perceptual phenomenon is referred to herein as a "cliff." Cliffs may be perceived even when the luminance of the LED is such that the LED is still technically on. Further, cliffs may occur in the opposite direction, i.e., when the LED is brightening. In such an operation, the LED may appear to steadily brighten then abruptly snap or jump to a higher brightness instead of continuing to steadily brighten. Another embodiment of the present invention may adjust the LED's luminance to avoid or minimize the creation of such a cliff.

Yet another exemplary embodiment of the present invention takes the form of a method for varying a luminance of a light, including the operations of varying an input to the light, the input affecting the luminance, setting a threshold value for the luminance of the light, and adjusting a rate of change of the input when the luminance is below the threshold. This exemplary embodiment may also include the operations of determining a target luminance to be reached by the luminance of the light, determining a minimum time in which the target luminance may be reached, setting a minimum number of increments necessary to vary the luminance from an initial luminance to the target luminance, and changing the luminance of the light from the initial luminance to the target luminance in a number of increments at least equal to the minimum number of increments.

Still another exemplary embodiment of the present invention takes the form of a method for varying a luminance of a light, including the operations of determining a target change in a signal, the signal setting the luminance of the light, determining the lesser of the target change and a maximum allowed change, and limiting a change in the signal to the lesser of the target change and the maximum allowed change, thereby limiting a rate of change in the luminance of the light.

A further embodiment of the present invention takes the form of a method for varying a luminance of a light, including the operations of setting a target luminance of the light, and changing the luminance of the light from a current luminance to the target luminance, wherein the operation of changing the luminance of the light from the current luminance to the target luminance occurs within a predetermined time.

Still another embodiment of the present invention takes the form of a method for changing a luminance of a light, including the operations of determining a target luminance to be reached by the luminance of the light, determining a minimum time in which the target luminance may be reached, setting a minimum number of increments necessary to vary the luminance from an initial luminance to the target luminance, and changing the luminance of the light from the initial luminance to the target luminance in a number of increments at least equal to the minimum number of increments.

Further embodiments of the present invention may take the form of an apparatus, including a computing device or computer program, configured to execute the any of the methods disclosed herein.

It should be noted that all references herein to an LED are equally applicable to any light-emitting element, including a cathode ray tube (CRT), liquid crystal display (LCD), fluorescent light, television, and so forth. Accordingly, the general operations described herein may be employed with a number of different devices. Further, although several of the embodiments described herein specifically discuss a digital implementation, analog embodiments are also embraced by the present invention. As an example, an analog embodiment may vary voltage to a light source instead of varying a pulse-width modulation duty cycle. Alternatively, a digital or analog-controlled current source could be used to control the light-emitting element.

DETAILED DESCRIPTION

Figure 1:
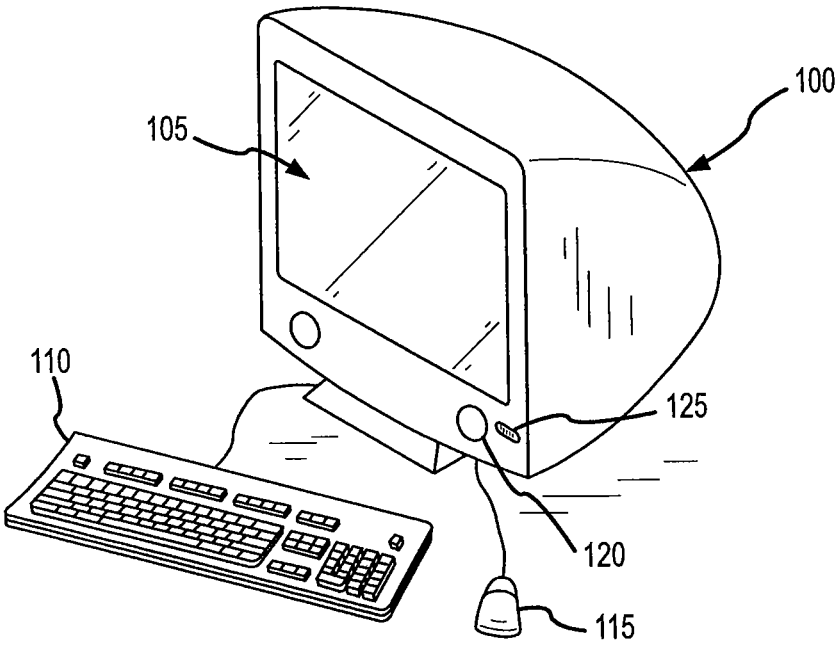
FIG.1 PRIOR ART
FIG. 1 is a perspective view of a computer system according to the prior art.

Many electronic devices, including computers (whether desktop, laptop, handheld, servers, or any other computing device), monitors, personal digital assistants, portable video players and portable music players, have a status indicator light, such as a light-emitting diode ("LED"), used to indicate whether the device is in its off state (e.g., LED off), its on state (e.g., LED on) or other power states such as its sleep state (e.g., LED pulses). To provide a more pleasing visual appearance to the user, the luminance of the LED may be ramped from one luminance level to another luminance level to avoid too rapid of a change in brightness, which may be distracting to the user. As used herein, the term "brightness" refers to how bright the LED appears to the eye and the term "luminance" refers to the absolute intensity of light output of the LED. Because of the non-linearity of human perception of luminance change, which is based in part on contrast, a linear change in luminance over time may not appear as a linear change in brightness to the user.

To perceive a point source of light, the human eye needs contrast between the point source and its background. This is why a bright star is clearly visible in the dark night sky, yet completely invisible to the eye through sunlight scattered by the atmosphere during the daylight hours. Similarly, the eye can only perceive the brightness of a system status light, such as an LED, when sufficient contrast exists between the LED and the ambient light reflected off a surrounding bezel. As used herein, the term "bezel" refers to the area surrounding the LED.

The perceived brightness of an LED generally is a function of (1) the type of LED, (2) the electrical current flowing through the LED, (3) the transmissivity of the light transmission path between the LED and the user, (4) the viewing angle, and (5) the contrast between the light emitted from the LED and the light reflected by the surrounding area, such as the bezel. The amount of incident light reflected by the bezel is a function of, among other things, the ambient lighting conditions (including the location, type, and luminance of all ambient light sources), the viewing angle, the color of the bezel, and whether the bezel has a matte or shiny finish. An ambient light sensor may be used to measure the incident light falling on the bezel. The reflectivity of the bezel can be determined during the design phase of a product. Thus, by monitoring the ambient lighting conditions and knowing the reflectivity of the bezel, the LED brightness may be controlled by manipulating its luminance to produce perceived smooth (possibly linear) changes in brightness as the LED is turned on, turned off, brightened, dimmed or pulsed, regardless of the ambient lighting conditions. This provides the user with a system status indicator light that has a pleasing visual effect under a wide variety of ambient lighting conditions.

An LED produces light in response to an electrical current flowing through the LED. The amount of light produced is typically proportional to the amount of current flowing through the LED. Thus, the luminance of the LED can be adjusted by varying the current flow. One method and system for producing variable LED output in an electronic device is described in U.S. Patent Application Publication No. US 2006/0226790, titled "Method and System for Variable LED Output in an Electronic Device," filed on Apr. 6, 2005, naming Craig Prouse as inventor and assigned to Apple Computer, Inc., the disclosure of which is hereby incorporated by reference as if set forth fully herein (hereinafter "Prouse").

The color of the light emitted by an LED is a function of the instantaneous current flow through the LED, while the average luminance of the LED is a function of the average current flow through the LED. In order to avoid changing the LED's color as its luminance is changed, the "on current" through the LED should be maintained at a constant value as the duty cycle of that current is varied. A pulse-width modulator ("PWM") control circuit may be used by some embodiments of the present invention to control the luminance of an LED status indicator light at a given color. In these embodiments, the luminance of the LED is determined by the duty cycle of a PWM generator which determines the average LED current flow. When the PWM generator duty cycle is changed from a higher duty cycle to a lower duty cycle, the average current flow in the LED decreases causing the luminance of the LED to decrease with no perceived flicker during the luminance change. One exemplary embodiment implements a variable slew rate control that reduces the rate of change in luminance of the LED below a tunable threshold luminance value to minimize the cliff effect.

Figure 2:
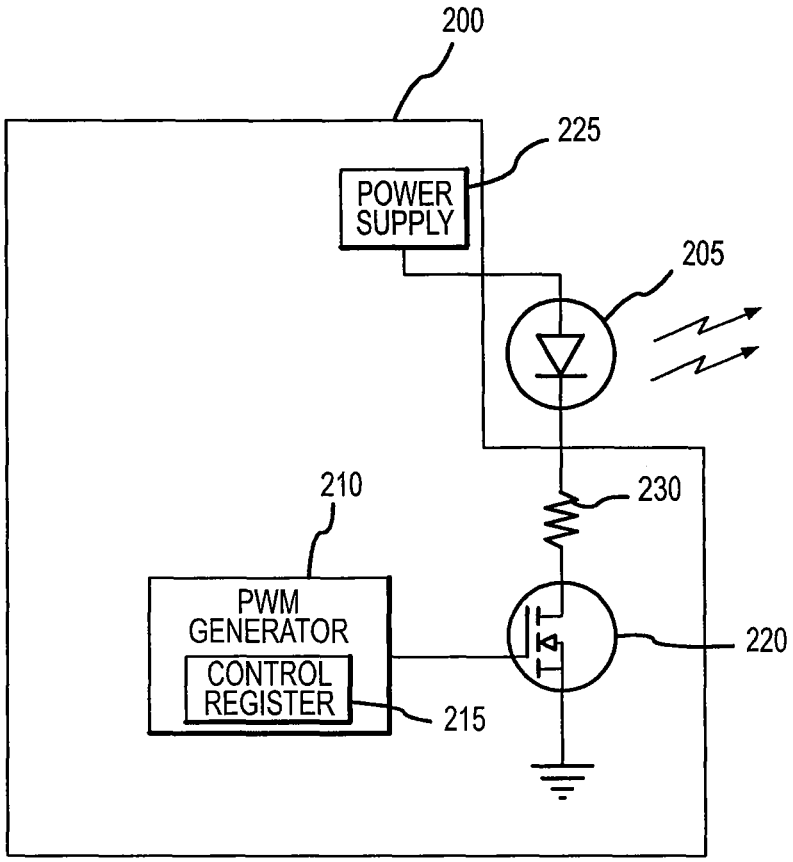
FIG. 2 is a block diagram of an exemplary LED luminance control circuit in accordance with an exemplary embodiment of the invention.

As shown in FIG. 2, the PWM control circuit 200 may include a PWM generator 210 with a 16 bit control register 215, a transistor switch 220, a power supply 225 and a current-limiting resistor 230 that controls the instantaneous luminance of the LED 205 when it is on. The PWM generator 210 produces a pulse-wave output with a duty cycle determined by the control register 215. The output voltage drives the control input of the transistor switch 220. A control register value of 0 results in the PWM generator 210 producing an output signal with a zero duty cycle. This turns the LED off because no current flows through the LED. A control register value of 65535 produces an output signal from the PWM generator with a duty cycle of 100%. This produces the maximum current flow through the LED to produce the maximum possible luminance. The maximum current flow I is determined by the power supply voltage, $V_S$, the forward voltage drop across the LED, $V_f$, and resistance R of the current-limiting resistor 230 and is given by the following equation (assuming negligible voltage drop across the transistor switch 220):

$$I=(V_S-V_f)/R.$$

The remaining intermediate control register 215 values may be used to vary the average luminance of the LED 205 by controlling the duty cycle of the PWM generator 210, i.e., intermediate register values yield intermediate average luminances. Other embodiments may use a PWM control register with more or fewer bits. Additionally, it should be understood that FIG. 2 depicts an elementary circuit. Certain embodiments of the present invention may employ more sophisticated LED drive circuits than depicted. For example, a constant current source may be used instead of a current-limiting resistor to set the current magnitude.

Generally, to provide a more pleasing visual effect when the LED goes from on to off (or off to on), the PWM control circuit may ramp the average luminance of the LED from on to off (or off to on) rather than instantaneously stepping the average luminance of the LED from on to off (or off to on), i.e., by ramping the PWM value down from the on value to the off value (or up from the off value to the on value) over a specified period of time. For example, the ramp duration may be approximately one-half second in one embodiment of the present invention. The ramp duration may correspond to a specified number of PWM update cycles (herein referred to as ticks), for example, 76 ticks in one embodiment, with the ticks occurring at a rate of 152 ticks per second. At each tick, the PWM control register value sets the duty cycle of the PWM generator's output signal waveform which in turn sets the average current flow through the LED. Changing the duty cycle of the signal waveform over time can be used to animate the luminance of the LED and adjust a brightness waveform perceived by the user. The "brightness waveform" refers to the perceived brightness of the LED over time as seen by an observer. Other embodiments may use a ramp duration that is longer or shorter than half a second and may use PWM update cycles that are longer or shorter.

Figure 3A:
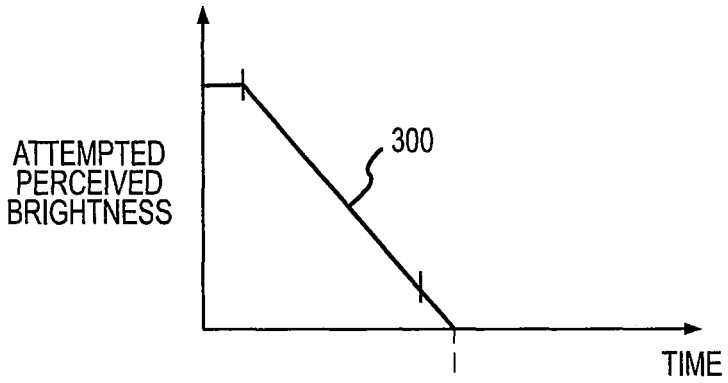
FIG. 3A depicts an attempted perceived LED brightness over time.
Figure 3B:
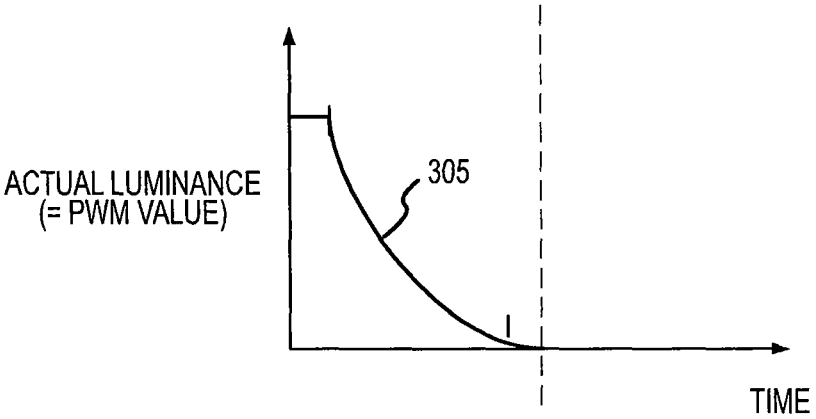
FIG. 3B depicts an actual LED luminance over time.
Figure 3C:
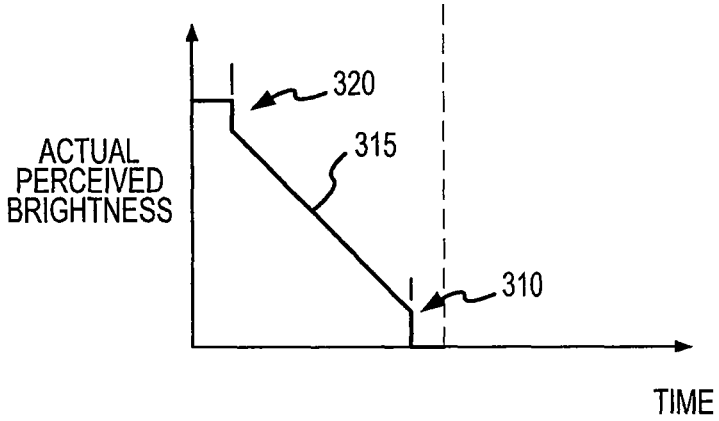
FIG. 3C depicts an actual perceived LED brightness over time.

Because average LED luminance is proportional to the average current through the LED, and the average LED current is proportional to PWM duty cycle in at least one exemplary embodiment, one might intuitively assume that the perceived brightness of the LED would be proportional to PWM duty cycle. However, typically this is not the case. FIG. 3A shows an example of a desired perceived brightness 300 of the LED status indicator as the PWM generator ramps the average LED luminance from the "on" state to the "off" state by reducing the PWM value using a linear contrast curve 305, shown in FIG. 3B. The term "linear contrast curve" refers to a luminance curve showing that the average luminance may be changed non-linearly over time in such a way that a human viewer may perceive a linear change in contrast (and therefore a linear change in brightness) over time. Even when the PWM value follows the linear contrast curve (and therefore slows its rate of change as it nears 0), a "cliff" 310 in the actual perceived brightness 315 may still be seen, as shown in FIG. 3C, due to the eye being more sensitive to changes in the LED brightness when the LED is dim compared to when the LED is bright. As FIG. 3C also shows, a cliff 320 may also be observed in the actual perceived brightness 315 due to the steep slope of the linear contrast curve 305 when the LED is bright. As used herein, the term "cliff" refers to near vertical portions of the actual perceived brightness curve, i.e., those portions where the eye perceives that the brightness is changing abruptly even though the actual luminance of the LED is changing smoothly.

When the LED is dim, the cliff effect in perceived brightness (such as 310 in FIG. 3C) as the LED is turned off (or on) may be minimized by setting a "flare ceiling" or threshold value for luminance such that when the luminance of the LED drops below the "flare ceiling," the rate of change in luminance is gradually and increasingly slowed so that the eye continues to perceive a smooth change in the LED brightness. In some embodiments, the threshold may be set as a PWM value instead of a luminance value for the LED with the same effect, insofar as the LED luminance is directly proportional to the PWM value that is entered into the PWM control circuit. This type of control is similar to a pilot flaring an airplane to slow its descent rate just before touching down on the runway, thus the name. That is, during landing, the pilot initially descends at a constant rate. When the airplane drops below a certain elevation, the pilot slows the rate of descent by pulling up the nose of the airplane. In a similar fashion, when the LED is turned off, its luminance can initially be ramped down following the linear contrast curve. When the luminance threshold or flare ceiling is reached, the rate of change in luminance is gradually and increasingly slowed even further than the rate specified by the linear contrast curve.

Figure 4:
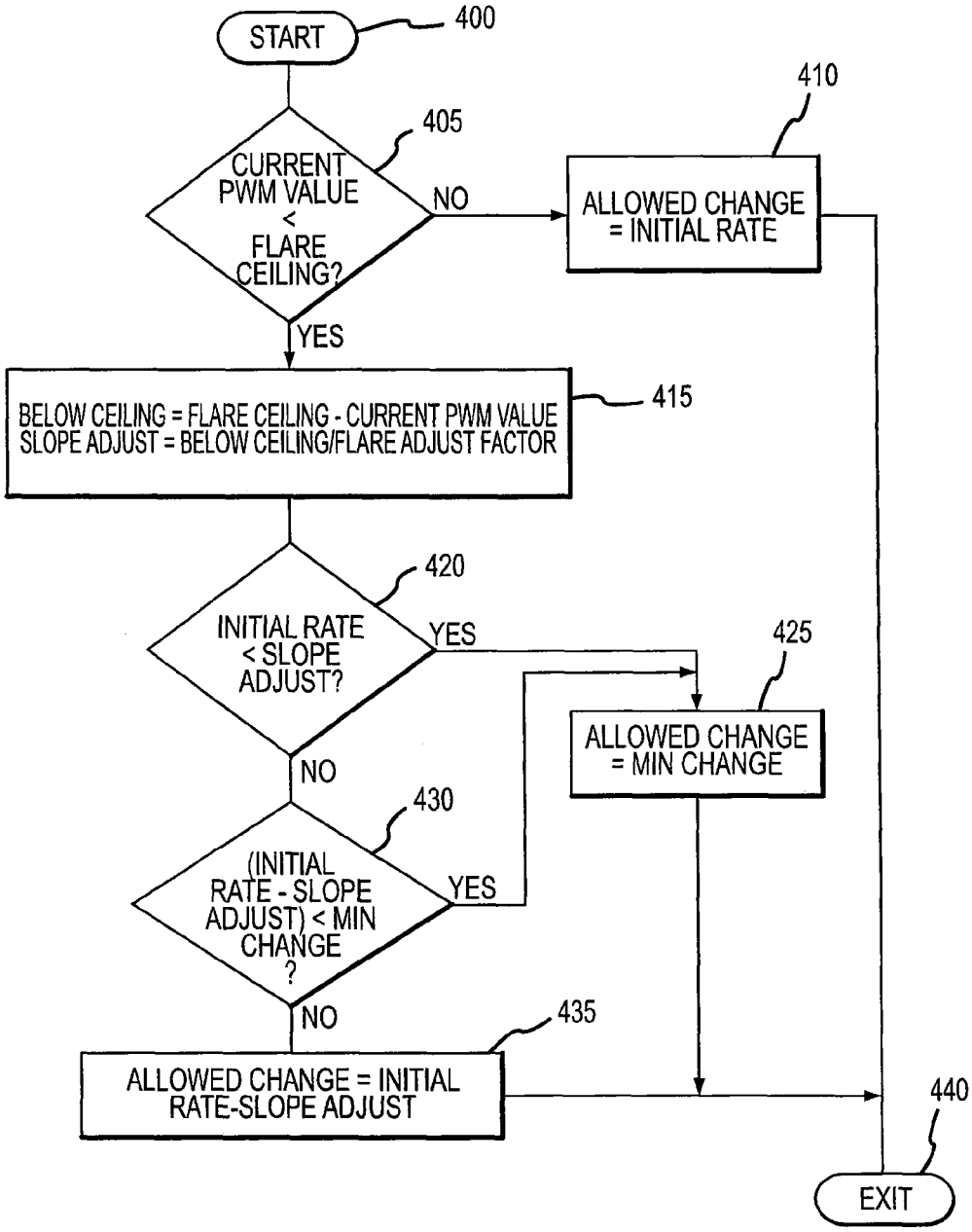
FIG. 4 depicts a flowchart illustrating the operations of one embodiment for implementing a variable slew rate control using a flare ceiling to suppress a cliff in perceived brightness when the LED status indicator fades down to, or up from, a low luminance value which may include an off state.

FIG. 4 depicts the flowchart illustrating the operations associated with a method conforming to various aspects of the present invention to reduce the rate of change in luminance when the LED is ramping at low luminance, i.e., a variable slew rate control system that uses a configurable flare ceiling to determine when the PWM values (corresponding to the LED's luminance) should be modified from a rate of change that was previously determined by another method, such as by the linear contrast curve, and herein referred to as the "initial rate", to a slower and even-more-gradually decreasing rate of change based on how far the most recent PWM value is below the flare ceiling. While this embodiment illustrates how a particular luminance control methodology may be modified to reduce cliffs, the embodiment may be used to modify other luminance control methodologies regardless of the luminance operating region and allowed luminance change to reduce perceived cliffs produced by those methodologies.

The embodiment begins in start mode 400. As the LED is ramped from on to off (or off to on), operation 405 is performed to determine if the most recent PWM value is below the flare ceiling. If not, operation 410 is performed where no adjustment to the initial rate (measured in PWM counts per tick) is necessary. Accordingly, in operation 410, the allowed change is set to the initial rate. The initial rate may be computed using the linear contrast curve or some other slew rate control methodology. Then operation 440 is executed and the process stops. However, if operation 405 determines that the most recent PWM value is below the flare ceiling, then operation 415 is performed.

During operation 415, the distance below the flare ceiling, i.e., "below ceiling," is computed in terms of PWM counts by subtracting the current PWM value from the flare ceiling. A slope adjustment, directly proportional to the distance below the flare ceiling (that is, the further below the ceiling, the larger the slope adjustment and therefore the slower the resulting rate of change) is also computed by dividing below ceiling by a configurable flare adjustment factor. Note that a smaller flare adjustment factor slows the rate of change more quickly than a larger one.

Following operation 415, operation 420 is performed to determine if the initial rate is less than the slope adjustment. If so, then operation 425 is performed. Operation 425 sets the allowed change to a configurable minimum change per tick. Then operation 440 is performed and the process stops.

If operation 420 determines that the initial rate is not less than the slope adjustment, then operation 430 is performed to determine if the initial rate minus the slope adjustment is less than the minimum change per tick (use of a minimum change per tick that is greater than zero ensures that the final PWM value is reached). If operation 430 determines that the initial rate minus the slope adjustment is not less than the minimum change per tick, then operation 435 is performed. Operation 435 sets the allowed change to the initial rate minus the slope adjustment. Then operation 440 is performed and the process stops. If operation 430 determines that the initial rate minus the slope adjustment is less than the minimum change per tick, then operation 425 is performed to set the allowed change to the minimum change per tick. Then operation 440 is performed and the process stops.

As illustrated by the flowchart of FIG. 4, when the PWM count is below the flare ceiling the allowed rate of change in PWM count becomes equal to the initial rate reduced by the slope adjustment but is never less than the minimum PWM change per tick value. In one embodiment, the flare ceiling is set to a PWM value of 10,000 for both ramp downs and ramp ups, the flare adjustment factor is set to 28 for ramp downs and 32 for ramp ups, and the minimum change per tick is set to 22 for both ramp downs and ramp ups, while in other embodiments the configurable parameters are set to other values during design or are user selectable.

Turning an LED on or off by following the linear contrast curve can also introduce a perceived cliff in LED brightness when the LED's luminance is ramping near its maximum luminance due to the steep slope of the linear contrast curve in that region. For example, as the LED is ramped from off to on, once a given brightness level is reached, a user may perceive that the LED "jumps" to its fully on brightness (this is the "cliff" effect). The point at which this cliff occurs varies with the user's sensitivity to such effects and the light reflecting off of the surrounding area, but typically occurs when the LED's 16-bit PWM value exceeds 50,000.

Another embodiment of the present invention minimizes this top cliff in perceived brightness by introducing an allowed maximum PWM change per tick when the LED luminance is ramped to make the LED brighter or dimmer, or to turn the LED on or off. Initially, a slew rate control methodology based on the linear contrast curve may be used to compute a target PWM change per tick based on a target PWM value, a prior PWM value, and/or the number of PWM update ticks over which the luminance change is to occur.

The target PWM change per tick is then compared with the allowed maximum PWM change per tick. In some embodiments the max PWM change per tick may be user selectable or selected by a designer at the time an embodiment is configured (i.e., is designer selectable), while in other embodiments it may be set by hardware or software to 400 or another fixed value. The lower of the two values is used to limit the change in duty cycle of the PWM generator's output at each tick to provide a less abrupt change in perceived brightness. Thus, in those cases where the linear contrast curve would allow too large a change in PWM value per tick, this embodiment limits the change in PWM value to a predetermined value to minimize any perceived cliff in the brightness of the status indicator light as it is turned on or off.

Figure 5:
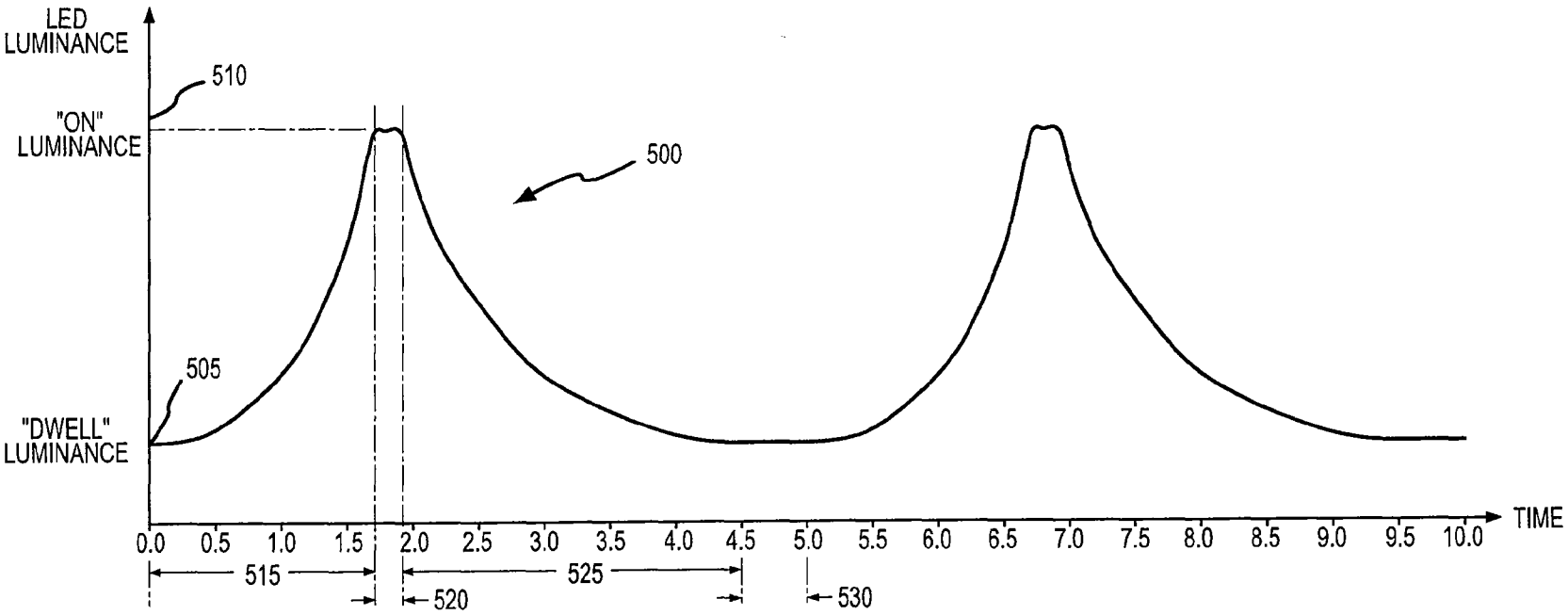
FIG. 5 depicts a waveform diagram used by one embodiment to control the pulse-width modulator generator of FIG. 2 to cause an LED status indicator to pulse.

As previously mentioned, the status indicator light may also be pulsed to indicate that the electronic device is in a special power state such as a sleep state. When using a PWM generator to control LED brightness, the pulsing of the LED on and off during sleep mode may be implemented with a "breathing curve" 500 as illustrated in FIG. 5. The breathing curve generally has a pulse-like shape with a minimum breathing luminance (also called "dwell luminance") 505, an on luminance 510, a rise time 515, an on time 520, a fall time 525 and a dwell time 530. In one implementation, the breathing curve has a rise time of 1.7 seconds, an on time of 0.2 seconds, a fall time of 2.6 seconds and a dwell time of 0.5 seconds for an overall period of 5 seconds. Other implementations may have breathing curves with faster or slower rise and fall times, and shorter or longer on and dwell times. In some embodiments, the breathing curve may indicate that the device is in a special power state, such as a sleep state, or may convey other information regarding the operation of a computing device or other device associated with the LED.

An envelope function may be employed to scale the breathing curve 500 or any other luminance scaling or adjustment described herein, such as ramping down or ramping up the luminance of an LED. Generally, the instantaneous output of the envelope function, which is multiplied times the value of the breathing curve or any other luminance scaling or adjustment described herein, is a fraction or decimal ranging from zero to one. Some embodiments may apply the envelope function to the breathing curve 500, or any portion thereof, to scale the curve in order to account for the brightness (or dimness) of a room or surrounding area, or to account for the time of day, and thus provide a more pleasing visual appearance, e.g., so that the LED does not appear to be too bright in dimly lit rooms or too dim in brightly lit rooms. Typically, a light sensor, as described below, may sense the ambient light conditions. Some embodiments may use the light sensor to determine the ambient lighting and select the value of the envelope function accordingly, while other embodiments may select the value of the envelope function based on the time of day. Thus, the actual value of the envelope function may vary with the ambient light or time of day and so too may the breathing curve 500.

Figure 6:
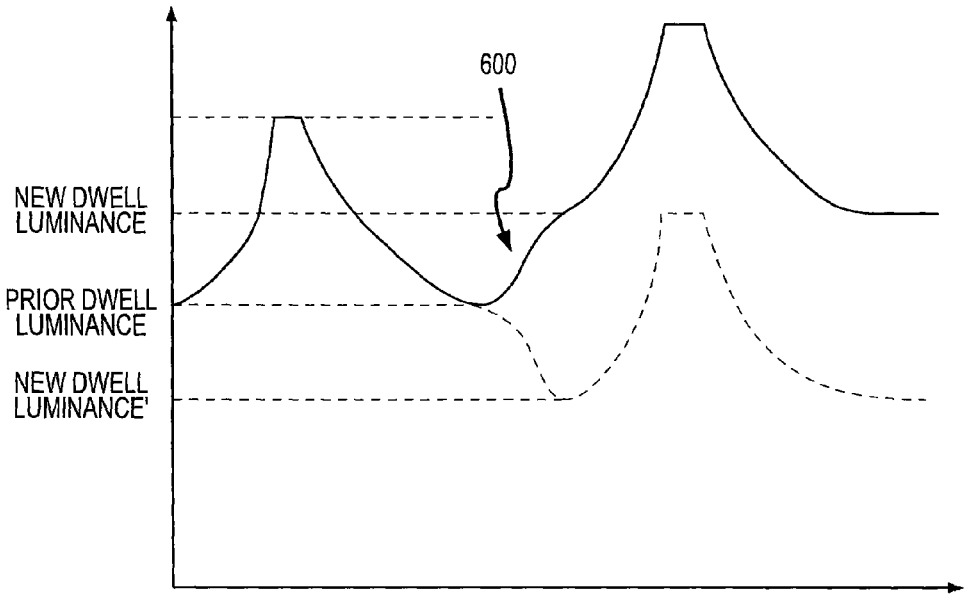
FIG. 6 depicts how the waveform diagram of FIG. 5 can be changed by one embodiment during the dwell time to reflect new ambient light conditions.

Whenever the ambient lighting conditions indicate that the relative brightness of the breathing curve should be scaled up or down, the change may be implemented by ramping the LED brightness from the old dwell luminance to the new dwell luminance during a specified time interval which may be the dwell time 600 as depicted in FIG. 6. As previously discussed above, the human eye is more sensitive to changes in an LED's brightness when the LED is dim compared to when the LED is bright. Thus, to provide a smoother visual appearance when ramping the LED luminance to the new dwell luminance level, another embodiment of the present invention employs a 3-step piecewise linear curve to ramp the LED luminance from the current dwell luminance to the new dwell luminance. The embodiment slew-rate limits the LED luminance as it ramps from the current dwell luminance to the new dwell luminance during the dwell time. The overall effect of using the 3-step piecewise linear curve is to reduce the rate of change in LED luminance in regions where the eye is more sensitive to changes in luminance, and to perceptually smooth the start and end regions of the ramp.

Figure 7:
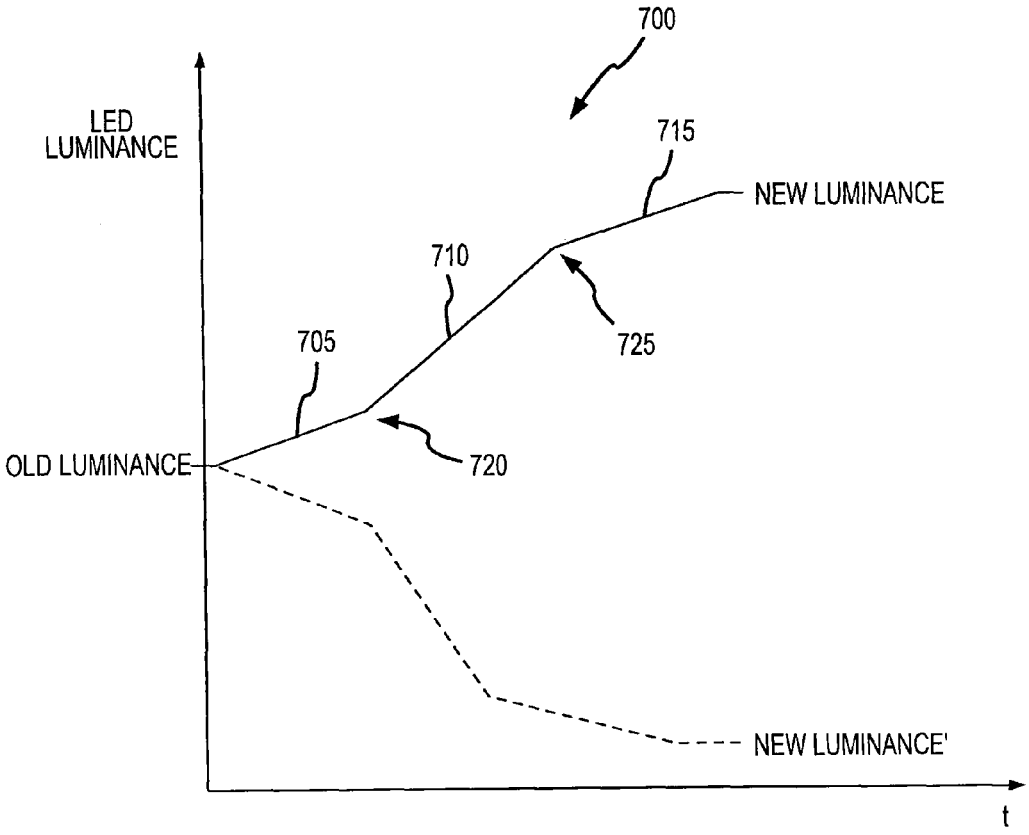
FIG. 7 depicts a 3-step piecewise linear curve employed by one embodiment to smooth the perceived change in LED brightness.

FIG. 7 depicts a 3-step piecewise linear curve 700 implemented by one embodiment. The curve 700 has a start segment 705, a middle segment 710 and an end segment 715. It also has a first break point 720 and a second break point 725. Note that the middle segment has a higher slew rate limit, i.e., the slope of the segment is greater, than does the start or end segment to make the perceived change in brightness appear less abrupt. The requested change in dwell luminance, which may be arbitrarily large, occurs during the dwell time. By "arbitrarily large," it is meant that a requested magnitude change may be of virtually any size. Therefore, the ramp produced by the present embodiment may be (and generally is) constrained both in time and magnitude.

The dwell time may be divided into three segments (start, middle and end). In some embodiments the user (or designer) can adjust the time duration for each segment (by specifying the break points) as well as the ratio of the step size (relative to the middle segment step size) of the start and end segments. That is, the user/designer can adjust the slope (PWM slew rate) of each segment to provide a breathing curve that appears most pleasing to the user/designer. Other implementations may fix the duration of the start segment, the duration of the end segment, the ratio of the middle to start segment step size, $Q_S$, and the ratio of the middle to end segment step size, $Q_E$.

In one particular embodiment, a system timer may be employed that generates 152 ticks per second and the dwell time may be 0.5 seconds or 76 timer ticks (T). Thus, $$T=T_S+T_M+T_E, \text{ where:}$$

$T_S$ represents the number of timer ticks in the start segment, $T_M$ represents the number of timer ticks in the middle segment and $T_E$ represents the number of timer ticks in the end segment.

In one particular embodiment, $T_S$, $T_E$, $Q_S$, and $Q_E$ may be fixed. To change dwell luminance, the embodiment calculates Δ, which represents the total change in luminance in PWM counts that should occur over the dwell time as follows:

$$\Delta=|\text{new dwell luminance}-\text{old dwell luminance}|, \text{ where } \| \text{ denotes magnitude.}$$

The embodiment then determines $V_M$, the PWM step size in the middle segment. Given that $$V_S=V_M/Q_S=\text{the PWM step size in the start segment; and}$$

$$V_E=V_M/Q_E, \text{ the PWM step size in the end segment; then}$$

$$\Delta=T_S*V_M/Q_S+T_M*V_M+T_E*V_M/Q_E; \text{ or}$$

$$V_M=\Delta/(T_M+T_S/Q_S+T_E/Q_E).$$

In one embodiment, $V_M$ may be calculated using integer division which truncates any fractional part of $V_M$. Thus, to make sure the middle step size is large enough so that the total ramp in luminance happens within the dwell interval, 1 is added to $V_M$. In alternative embodiments, the total ramp in luminance may not occur completely within the dwell interval.

Once $V_M$ has been calculated, $V_S$ and $V_E$ may be calculated by the embodiment as follows (where 1 is again added to each equation to compensate for truncation caused by integer division):

$$V_S=V_M/Q_S+1; \text{ and}$$

$$V_E=V_M/Q_E+1.$$

In one particular embodiment, $T_S$=3, $T_E$=25, $Q_S$=2, and $Q_E$=3 for ramp downs, and $T_S$=20, $T_E$=3, $Q_S$=3, and $Q_E$=2 for ramp ups. It should be noted that each of these values may be separately tuned. Further, and as implied above, the values may vary in a single embodiment between a ramping-up operation and a ramping-down operation. Accordingly, various embodiments of the present invention may embrace bi-directional tuning (i.e., tuning separately for ramp-ups and ramp-downs).

The exemplary embodiment described above uses the 3-step piecewise linear curve method to produce a ramp that is constrained in both time and magnitude in the context of a dwell period of a breathing curve. Alternative embodiments, including any embodiment disclosed herein, may use the same 3-step piecewise linear curve method to produce a ramp that is constrained in both time and magnitude and is applied to any other context discussed herein or that requires such a ramp.

Generally, an ambient light sensor may be used by the embodiment to monitor the ambient light conditions. A variety of solid state devices are available for the measurement of illumination. In some embodiments, a TAOS TSL2561 device, manufactured by Texas Advanced Optoelectronic Solutions of Plano, Tex., may be used to measure the ambient illumination. Alternative embodiments may use other light sensors. The light sensor measures the ambient light in the surrounding environment, such as a room, and generates a signal that represents the amount of measured light. The light sensor generally integrates the light collected over an integration time and outputs a measurement value when the integration time expires. The integration time may be set to one of several pre-determined values, and is set to 402 milliseconds in one embodiment of the present invention. Other embodiments may use light sensors that output light measurement values using other techniques. By way of example only, the light sensor may output light measurement values based upon user or designer actions, such as pressing a button or setting a sample interval in a control panel. The light sensor alternatively may output a light measurement value when light or brightness changes in the surrounding environment exceed a predetermined threshold.

When the LED brightness changes automatically in response to ambient lighting conditions, a human user may perceive discontinuities in the LED's rate of change in brightness that occur due to a new ambient light level being reported by the system's ambient light sensor. The discontinuities are particularly noticeable (and thus undesirable) when the room's lighting is gradually increasing or decreasing such that the LED reaches its target brightness and holds there in less time than it takes to obtain the next ambient light reading.

These discontinuities can be smoothed by imposing a minimum time that should pass before the LED is allowed to reach a target brightness. In one embodiment this may be done by imposing a minimum number of timer ticks to target that is larger than the minimum number of timer ticks required to obtain the next ambient light sensor reading. Then, during a change in LED luminance, the LED will not plateau at its target luminance before a new light reading is available. Alternatively, a maximum step size (in terms of PWM counts per timer tick) for a change in LED brightness can be imposed. By imposing such conditions, the LED's change in luminance is slew rate limited appropriately so that the human viewer typically perceives a smooth LED change in brightness over a wide variety of changing light conditions.

Figure 8:
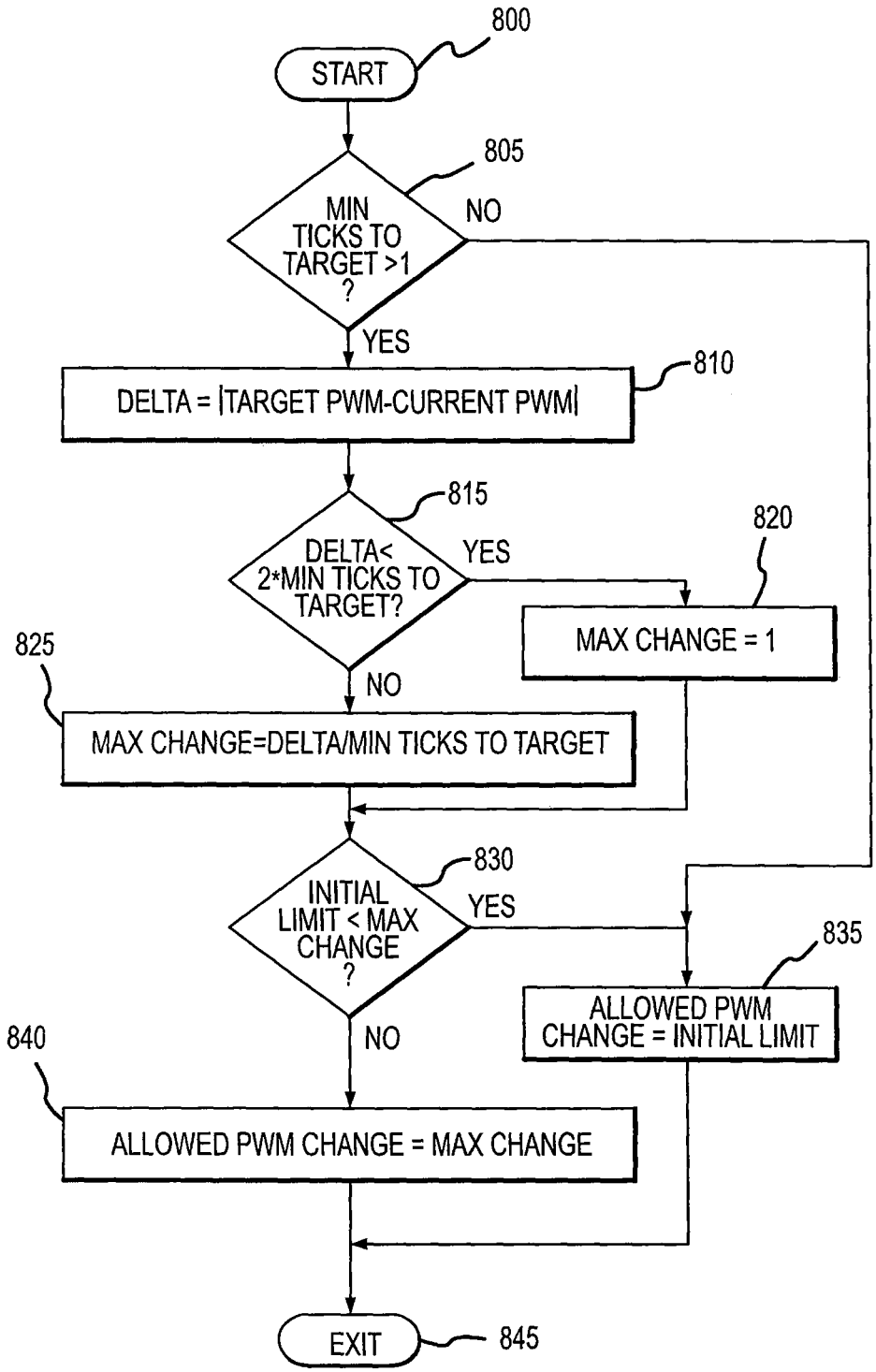
FIG. 8 depicts a flowchart illustrating the operations of one embodiment for implementing a minimum ticks to target luminance control.

FIG. 8 depicts a flowchart of the operations of one particular embodiment to implement a minimum ticks to target slew rate control methodology used to control the luminance of the LED status indicator when its target luminance changes in response to a change in ambient lighting or for any other reason. The methodology limits the allowed PWM change per timer tick that is used to update a PWM generator. The minimum ticks to target may be user selectable (or designer selectable) using a control panel in some embodiment or may be set by hardware or software to 70 or some other value in other embodiments. For best results, the minimum ticks to target should be set such that the time required to obtain a new ambient light reading is less than the following time: the minimum ticks to target times the time per tick.

The flowchart of FIG. 8 may be performed when the ambient light sensor reading (or any other suitable control methodology) indicates that the LED's luminance should be changed. The embodiment begins in start mode 800 and assumes that a prior initial limit on the PWM's rate of change has already been established. The initial limit is an unconstrained value (i.e., it has not yet been constrained by this methodology) that may allow the LED luminance to plateau before the next ambient light sensor reading is available. The initial limit may be set by an operation or embodiment described herein, any operation or embodiment of Prouse, any other suitable control methodology, or any combination thereof.

Next, operation 805 is performed. In operation 805, a check is performed to determine if the minimum ticks to target is greater than one. If not, operation 835 is performed. In operation 835, the embodiment sets the allowed PWM change per tick to the initial limit. Once this is done, operation 845 is executed and the process stops.

However, if operation 805 determines that the minimum ticks to target is greater than 1, then operation 810 is performed. In operation 810, the embodiment computes the magnitude of the luminance change to be made (a delta to target) by taking the absolute value of the difference in the target PWM value and the current PWM value. Expressed mathematically, this is: delta to target=|target PWM value−current PWM value| where || denotes absolute value.

Next operation 815 is performed. In operation 815 a check is performed to determine if the delta to target is less that two times the minimum ticks to target. If yes, then operation 820 is performed in which the maximum change is set to 1. Otherwise operation 825 is performed.

Operation 825 determines the maximum change by dividing delta to target by the minimum ticks to target using integer division. Expressed mathematically, this is: maximum change=delta to target/minimum ticks to target.

After operation 820 or operation 825 is executed, the embodiment performs operation 830. In operation 830 a check is performed to determine if the initial limit is less than the maximum change. If so, then operation 835 is performed. Operation 835 sets the allowed PWM change per tick to the initial limit.

If operation 830 determines that the initial limit is not less than the maximum change, then operation 840 is performed. Operation 840 sets the allowed PWM change per tick to the maximum change. After operation 835 or operation 840, the embodiment executes operation 845 and the process stops.

Thus, in this embodiment, the allowed maximum change per tick is determined so that the target LED PWM value is not achieved before the next ambient light sensor reading by choosing the minimum ticks to target such that the minimum ticks to target times the time per tick is greater that the time required to obtain the next ambient light reading. If the delta to target is less than two times the minimum ticks to target, the maximum change is set to 1 (not zero) to make sure the target PWM value can eventually be achieved.

Other embodiments of the present invention may incorporate awareness of time such that different LED luminance slew rate methodologies may be applied during different time periods within a repetitive changing brightness pattern. For example, referring back to FIG. 5, one slew rate methodology could be applied only during the dwell time 530 (such as the methodology shown in FIG. 6), while other slew rate methodologies could be applied during the rise and fall times 515, 525, respectively. As yet another example, any of the embodiments herein may occur only during certain time periods and be inactive during other time periods. Continuing the example, the methodologies of FIGS. 4 and/or 8 may occur only between certain hours such as 8 p.m. and 7 a.m., or be time-bounded in any other manner.

Although the present embodiment has been described with respect to particular embodiments and methods of operation, it should be understood that changes to the described embodiments and/or methods may be made yet still embraced by alternative embodiments of the invention. For example, certain embodiments may operate in conjunction with an LCD screen, plasma screen, CRT display, and so forth. Yet other embodiments may omit or add operations to the methods and processes disclosed herein. Still other embodiments may vary the rates of change of brightness and/or luminance. Accordingly, the proper scope of the present invention is defined by the claims herein.

What is claimed is:

1. A luminance control circuit comprising:

a switch in communication with a light, the light having a minimum luminance level and a maximum luminance level;

a pulse-width modulator (PWM) generator configured to generate a PWM signal to control the operation of the switch; and a control register in communication with the PWM generator and configured to determine a duty cycle of the PWM signal by providing to the PWM generator one of a maximum allowed change for the PWM signal or a determined target change for the PWM signal;

wherein the luminance control circuit is configured to compare the maximum allowed change for the PWM signal to the determined target change for the PWM signal, determine if the determined target change for the PWM signal is less than the maximum allowed change for the PWM signal and if so, providing the determined target change to the PWM generator, and if not providing the maximum allowed change to the PWM generator.

2. The circuit of claim 1, wherein the switch comprises a transistor.

3. The circuit of claim 1, further comprising a power supply.

4. The circuit of claim 3, wherein the power supply comprises a current source.

5. The circuit of claim 3 further comprising a current-limiting circuit coupled in an electrically serial manner with the light.

6. The circuit of claim 1 wherein the control register comprises a 16 bit control register.

7. The circuit of claim 1, wherein the light comprises a light emitting diode.

8. The circuit of claim 1, wherein the control register is configured to vary the average luminance of the light.

9. The circuit of claim 1, wherein the maximum allowed change for the PWM signal is user-selectable.

10. The circuit of claim 1, wherein a change in the duty cycle corresponds to a change in the luminance of the light.

11. A luminance control circuit comprising:

a switch in communication with a light, the light having a minimum luminance level and a maximum luminance level;

a pulse-width modulator (PWM) generator configured to generate a PWM signal to control the operation of the switch; and a control register in communication with the PWM generator and configured to change a duty cycle of the PWM signal by providing to the PWM generator a change for the PWM signal, wherein the change for the PWM signal comprises a maximum allowed change for the PWM signal or a determined target change for the PWM signal, and wherein the PWM generator is configured to generate the PWM signal to control the operation of the switch based on the change for the PWM signal received from the control register;

wherein the luminance control circuit is configured to compare the maximum allowed change for the PWM signal to the determined target change for the PWM signal, determine if the determined target change for the PWM signal is less than the maximum allowed change for the PWM signal and if so, providing the determined target change to the PWM generator, and if not providing the maximum allowed change to the PWM generator.

* * * * *